US005564149A

United States Patent [19]

Matesic et al.

[11] Patent Number: 5,564,149

[45] Date of Patent: Oct. 15, 1996

[54] GEAR CLEANING TOOL

[75] Inventors: Robert J. Matesic, Webster; Robert C. Nihoff, Wolcott; Thomas L. Stickney, Pittsford, all of N.Y.

[73] Assignee: Xerox Corporation, Stamford, Conn.

[21] Appl. No.: 338,932

[22] Filed: Nov. 14, 1994

[51] Int. Cl.[6] ..... A46B 5/02; A46B 3/00

[52] U.S. Cl. ..... 15/160; 15/206; 15/104.04

[58] Field of Search ..... 15/159.1, 160, 15/164, 88.3, 88, 104.04, 104.92, 65, 67, 206, 104.04

[56] References Cited

U.S. PATENT DOCUMENTS

| | | | |
|---|---|---|---|
| 2,404,507 | 7/1946 | Link | 15/104.04 |
| 2,907,059 | 10/1959 | Cornett | 15/65 |
| 3,036,320 | 5/1962 | Behrendt | 15/65 |
| 3,913,163 | 10/1975 | Durham | 15/164 |
| 4,226,548 | 10/1980 | Reith . | |
| 4,414,037 | 11/1983 | Friedheim . | |
| 4,554,696 | 11/1985 | Nye, Jr. | 15/104.04 |
| 4,651,762 | 3/1987 | Bowden . | |
| 4,662,425 | 5/1987 | Musschoot et al. . | |
| 4,734,950 | 4/1988 | Schenke et al. | 15/104.92 |
| 4,911,189 | 3/1990 | Halbert . | |
| 5,222,271 | 6/1993 | Eganhouse | 15/104.04 |
| 5,245,925 | 9/1993 | Switall et al. . | |
| 5,299,587 | 4/1994 | Randall et al. . | |

FOREIGN PATENT DOCUMENTS

| | | | |
|---|---|---|---|
| 162869 | 5/1921 | United Kingdom | 15/67 |

*Primary Examiner*—David Scherbel
*Assistant Examiner*—Randall E. Chin
*Attorney, Agent, or Firm*—John S. Wagley

[57] ABSTRACT

A tool for removing contamination from the teeth of a gear is provided. The tool includes a body defining an aperture therethrough and a cleaner for cleaning the teeth of the gear. The cleaner is attached to the body and is adjacent to the aperture.

15 Claims, 2 Drawing Sheets

FIG. 2A
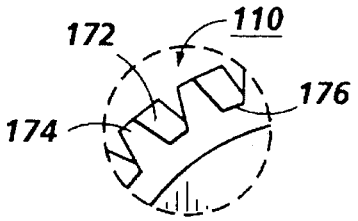
FIG. 2
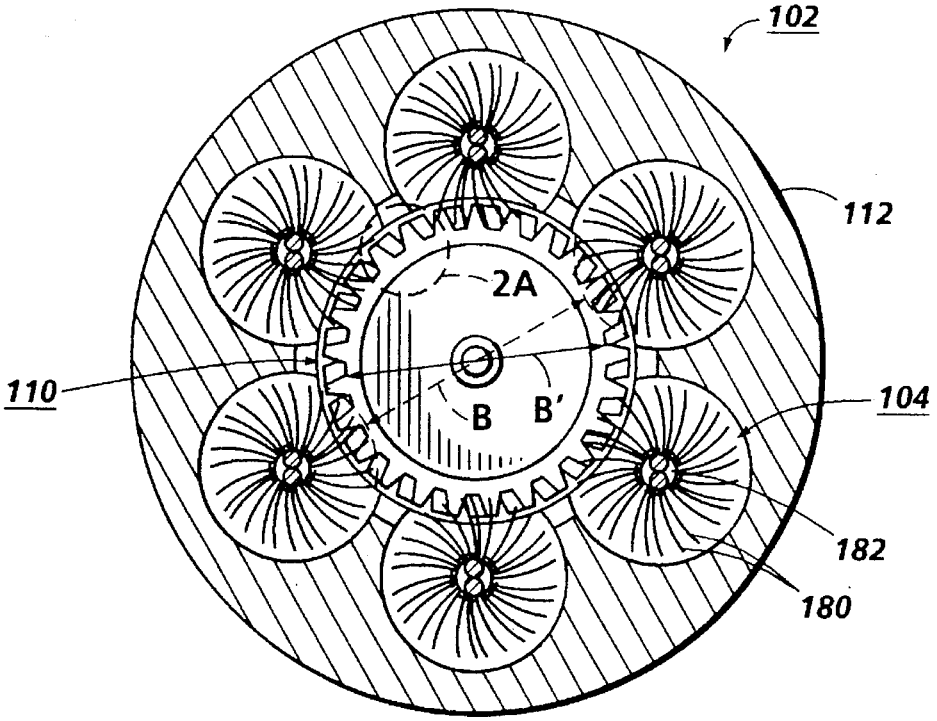
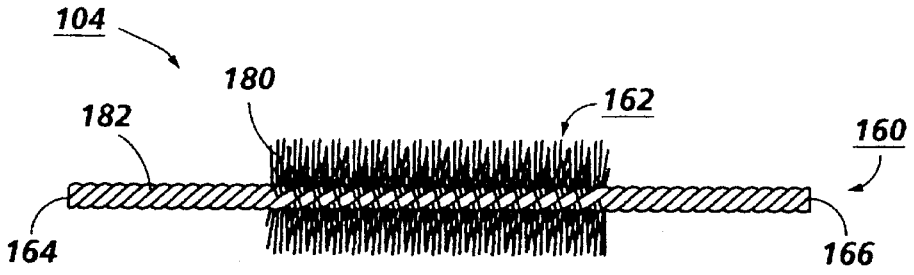
FIG. 3

GEAR CLEANING TOOL

The present invention relates to a method and apparatus for cleaning mechanical components. More particularly, the invention relates to an apparatus and method for cleaning contamination from gears.

The mechanical components that are used to fabricate mechanical assemblies generally need to be clean prior to their assembly. The cleanliness of the components is important whether the components are newly manufactured or recycled. If the components are used components which are being recycled into a remanufactured assembly the cleaning of the components may be particularly difficult. Components with irregular shapes are particularly difficult to clean. Chemical solvents may be used to clean these components, but the solvents may damage the components, leave residues thereon, contribute to air pollution, and add significant implementation and recovery costs.

In the well-known process of electrophotographic printing, the photoconductive member is electrostatically charged, and then exposed to a light pattern of an original image to selectively discharge the surface in accordance therewith. The resulting pattern of charged and discharged areas on the photoconductive member forms an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the photoconductive member is cleaned from the surface thereof. The process is useful for light lens copying from an original or printing electronically generated or stored originals such as with a raster output scanner (ROS), where a charged surface may be imagewise discharged in a variety of ways.

While the electrophotographic printing machine has a long service life, certain components require replacement on a more frequent basis. In addition to the toner, which is consumed as it is transferred to the paper, the photoconductive member and other items such as a blade to clean the excess toner from the photoconductive member and a corona generating device used to clean the photoconductive member wear at a significant rate. These high wear items are now often packaged together in a customer replaceable unit which includes a housing or cartridge to which, toner, the photoconductive member, the blade and the corona generating device are mounted. The customer replaceable unit is replaced when either the toner or photoreceptor in the unit is consumed. The unit is then disassembled by the manufacture where worn components are replaced and serviceable components are cleaned and reused.

The units include gears to transfer motion to the photoconductive member. These gears are very durable and can be reused. The gears in the returned units are coated with toner which is very difficult to remove from the surfaces of the teeth of the gears. Solvents must be used to clean the gears. The gears are dipped in a tank containing the solvent for an extended period of time and then removed. The solvent must then be removed from the gears. The solvent costs, related equipment costs, environmental effects costs, added inventory costs and labor costs involved in this process are large.

The following disclosures may be relevant to various aspects of the present invention:

U.S. Pat. No. 5,299,587

Patentee: Randall et al.

Issue Date: Apr. 5, 1994

U.S. Pat. No. 5,245,925

Patentee: Switall et al.

Issue Date: Sep. 21, 1993

U.S. 4,911,189

Patentee: Halbert

Issue Date: Mar. 27, 1990

U.S. Pat. No. 4,662,425

Patentee: Musschoot et al.

Issue Date: May 5, 1987

U.S. 4,651,762

Patentee: Bowden

Issue Date: Mar. 24, 1987

U.S. 4,414,037

Patentee: Friedheim

Issue Date: Nov. 8, 1983

U.S. Pat. No. 4,226,548

Patentee: Reith

Issue Date: Oct. 7, 1980

The relevant portions of the foregoing disclosures may be briefly summarized as follows:

U.S. Pat. No. 5,299,587 discloses an apparatus and method for immersing contaminated parts in a fluid. The contaminated parts are moved through the fluid with both a rotational and reciprocal movement. The compound movement of the contaminated parts cause the parts to be lifted from, and immersed within, the fluid.

U.S. 5,245,925 discloses a dry brush cleaning apparatus and a method for cleaning printing press blanket cylinders. The invention includes a frame spanning the width of the working surface of the blanket cylinder. At least one of a plurality of rollers is secured to the ends of the frame. At least one of the rollers is a drive roller to rotate the cylinders. A cleaning brush is rotatably mounted in the frame and serves to clean the cylinders.

U.S. Pat. No. 4,911,189 discloses an immersion type vapor degreaser. The degreaser has a tank divided into an immersion chamber and a boiling chamber. Parts are lowered in a basket into the immersion chamber and lifted therefrom. Contaminated liquid is drained into the boiling chamber, boiled, condensed, and returned to the immersion tank.

U.S. Pat. No. 4,662,425 discloses a vibratory parts scrubber for cleaning foreign material from the surfaces of a part. He scrubber includes a container of particulate material and a vibration generator for the container that creates an amplitude and a frequency that fluidizes the media. The part is placed into the container, the part being suspended from above by a hoist. The hoist is vibrated at a second, different amplitude and frequency to assist in the foreign material removal.

U.S. Pat No. 4,651,762 discloses an agitation type degreaser for cleaning oil from parts by cleaning them with a cleaning liquid. A container for holding the cleaning liquid has two chambers. The first chamber is agitation by a vibration device and the parts to be cleaned are placed therein. The second chamber is calm and oil is skimmed from the cleaning fluid in this chamber.

U.S. 4,414,037 discloses a system for cleaning and sterilizing. The system uses a dry steam jet. The steam is generated in a flash boiler. A reservoir contains a mixture of water and cleaning agent. The mixture is pumped into the flash boiler and the steam therefrom is directed by jet nozzles toward the parts to be cleaned.

U.S. Pat. No. 4,226,548 discloses a part cleaning system which includes a fluid container in which solvent is contained. A pump directs solvent through a tube having a brush on the nozzle thereof. An operator rests the part to be cleaned on a tray and directs the flow of solvent from the nozzle toward the part.

SUMMARY OF THE INVENTION

In accordance with one aspect of the present invention, there is provided a tool for removing contamination from the teeth of a gear. The tool includes a body defining an aperture therethrough and a cleaner for cleaning the teeth of the gear. The cleaner is attached to the body and is adjacent to the aperture.

In accordance with another aspect of the present invention, there is provided a method for removing contamination from the teeth of a gear. The method includes providing a body having an aperture therein, attaching a cleaning member to the body adjacent the aperture and moving the gear through the body so that the cleaning member contacts at least the teeth of the gear.

BRIEF DESCRIPTION OF THE DRAWINGS

The invention will be described in detail herein with reference to the following figures in which like reference numerals denote like elements and wherein:

FIG. 2 is a cross section view through the line 3—3 in the direction of arrows of FIG. 1; and FIG. 2A is a partial enlarged cross section view through the line 3—3 in the direction of arrows of FIG. 1 of a portion of the teeth of the gear; and FIG. 3 is an elevational view of a brush used in the gear cleaning tool of FIG. 1.

Figure 1:
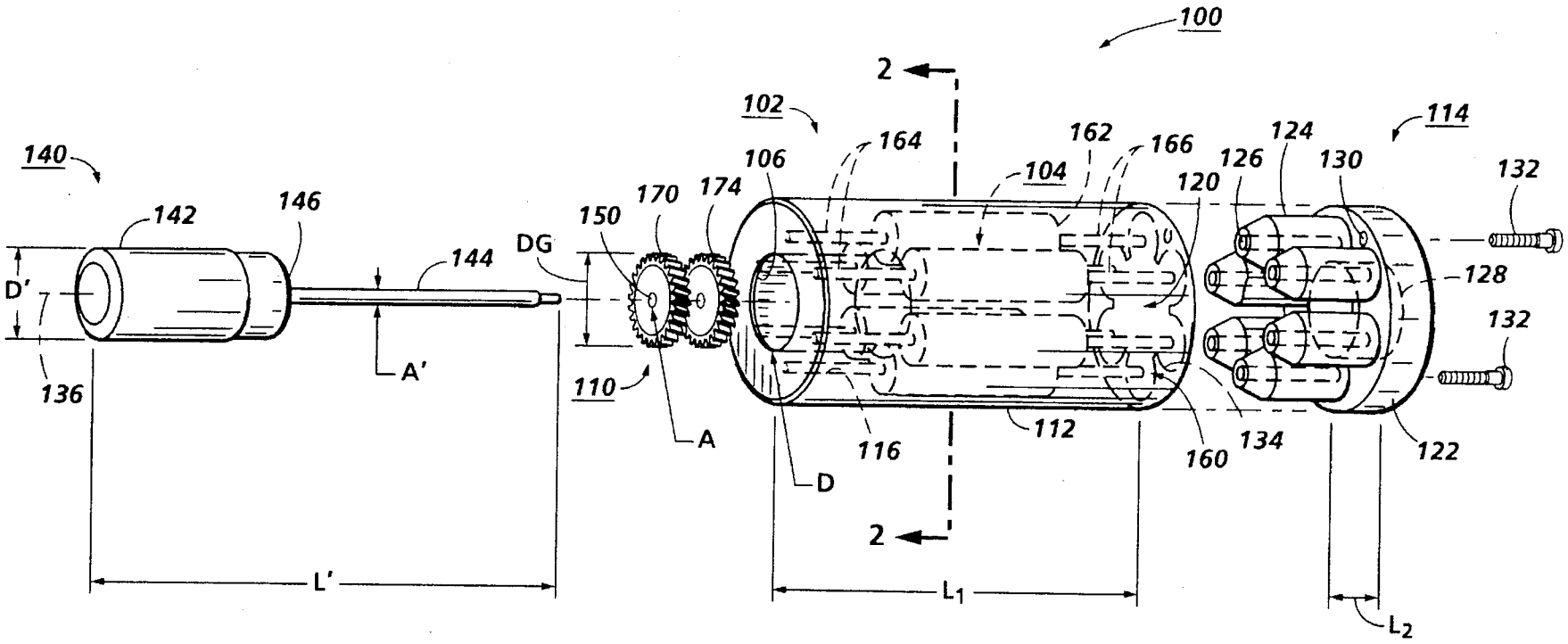
FIG. 1 is an exploded perspective view of a gear cleaning tool according to the present invention.

According to the present invention and referring first to FIG. 1, a tool 100 for cleaning contamination from gears is shown. The tool 100 includes a body 102 which holds a cleaning member 104. An aperture or gear passing opening 106 is formed in the body 102 to permit a gear 110 to be inserted through the opening 106 to allow the cleaning member 104 to clean the gear 110.

The body 102 may have any suitable shape and be made from any suitable durable material. The tool 100 may be hand held by a operator. If hand held, the body 102 should be made from a light, durable material and have a size suitable to be held in an operator's hand. It should be appreciated, however, that the body may be an integral part of a conveyor system or an automatic machine which would serve the loading function that an operator would otherwise provide. Furthermore, the tool may be used for much larger gears where the body 102 may not be suitable for hand holding and the gears may need to be lifted by another means such as a hoist.

The tool 100 as shown in FIG. 1 is suitable for small gears with a diameter DG of up to 3 inches. To assist in hand holding, the body 102 preferably has an elongated cylindrical shape and may include knurls or grooves (not shown) to assist in holding by an operator. The body 102 is preferably made of a lightweight material, preferably plastic. The body 102 may be transparent to assist the operator in observing the cleaning process.

To simplify design and manufacturing of the body 102 and to provide a removable way of securing the cleaning member 104 to the body 102, the body 102 preferably includes a housing 112 which receives and secures the cleaning member 104 and a cap 114 which matingly fits to the housing 112 to contain the cleaning member 104 therewithin.

The housing 112 includes the centrally located opening 106 as well as cleaning member receiving holes 116. The holes 116 are used to receive a portion of the cleaning member 104. The body 102 further includes a large opening 120 into which the cap 114 matingly fits.

The cap 114 includes a disc-shaped body 122 from which a plurality of stems 124 extend. The stems 124 have a centrally located channel 126 which assists in the support of the cleaning member 104. The disc-shaped body 122 includes a central opening 126 which serves to permit the passage of the gear 110 therethrough. The cap 114 preferably includes a feature for the securing of the cap 114 to the housing 112. For example, the cap 114 may include holes 130 for passing fasteners such as screws 132 therethrough to secure the cap 114 to the housing 112.

To provide alignment between the cleaning member receiving holes 116 in the housing 112 with the channels 126 in the stems 124 of the cap 114, the housing 112 preferably includes an angularly orienting device 134 which angularly orients the stems 124 with the housing 112. The cap 114, like the housing 112, is preferably made of a suitable durable material such as a plastic.

The cleaning member 104 is preferably removably located within the body 102. The cleaning member 104 typically wears and accumulates contamination during the cleaning process and must be occasionally replaced and/or cleaned. To accomplish this purpose, the cleaning member 104 may be removed from the housing 112 through the large opening 120 along tool longitudinal axis 136.

To assist in the movement of the gear 110 through the gear passing opening 106 in the body 102 of the tool 100, a gear urging means in the form of an elongated member gear feeder 140 is preferably used in conjunction with the tool 100. Gear feeder 140 includes a handle 142 from which a stem or journal 144 extends. The handle 142 includes a shoulder 146 adjacent the journal 144. The handle 142 may have any suitable shape, but, preferably has a cylindrical form. Knurls or grooves (not shown) may be located on the periphery of the handle 142 to assist in the retention of the gear feeder 140. The journal 144 preferably has a length sufficient to hold a plurality of gears, for example, six gears. The journal 144 typically has a shape similar to that of bore 150 of the gear 110 to permit the bore 150 of the gear 110 to pass onto the journal 144. Preferably, the journal 144 has a diameter A' which is slightly smaller than diameter A of the bore 150 of the gear 110. The gears 110 may thus be slid onto the journal 144 of the gear feeder 140. The handle 142 typically has a shape similar to that of opening 106 of the body 102. For example, the handle 142 may have a cylindrical shape similar to that of opening 106. As shown in FIG. 1, the handle 142 has a diameter D' which is slightly smaller than diameter D of the aperture 106 of the body 102 to permit the handle 142 of the gear feeder 140 to pass through the body 102. Likewise, the gears 110 have a diameter DG which is slightly smaller than the diameter D of aperture 106.

When utilizing the invention, the gears 110 are first slid onto the journal 144 of the gear feeder 140 and are urged against shoulder 146 thereof. The operator grabs the gear feeder 140 by the handle 142 and positions the gear feeder 140 with the gears loaded thereonto into the aperture 106 of the body 102. The operator continues to push the gear feeder 140 through the opening 106 by urging the gear feeder 140 along axis 136 until the handle 142 is pushed into the aperture 106. The operator then grabs the gear feeder 140 by the outer end of the journal 144 which has passed through opening 126 of the cap 114 and removes the gear feeder 140 containing the cleaned gears 110 from the tool 100.

To permit the passage of the gear feeder 140 through the body 102, the gear feeder 140 has a length L' slightly larger than the the sum of the length $L_1$ of the housing 112 and the length L2 of the cap 114 of the tool 100. When the handle 142 of the gear feeder 140 is completely pushed into the opening 106 of the body 102, the journal 144 will protrudes through the opening 126 of the cap 114. The operator may then grab the gear feeder 140 by the protruding journal 144 and remove the gear feeder 140 with the cleaned gears from the tool 100.

While the gear feeder preferably passes completely through the tool 100, it should be appreciated that tool may be designed without an opening in the cap. The gears in such a tool embodiment may be inserted into an end of the tool and withdrawn therefrom from the same end.

The cleaning member 104 may have any suitable shape but preferably to ease its mounting into the body 102, the cleaning member includes a stem 160 to which a cleaning member body 162 is attached. The stem 160 preferably extends beyond both ends of the body 162. First end 164 of the stem 162 matingly fits into holes 116 of the body 102, while second end 166 of the stem 162 slidingly fits into channels 126 of the stems 124 of the cap 114, thereby securing and aligning the cleaning member 104 within the body 102.

While the invention may be practiced with a single cleaning member 104, preferably, in order that the entire outer periphery 170 of the gear 110 be cleaned in one passage of the gear 110 through the body 102, a plurality of cleaning members 104 surround the opening 106 of the body 102. Such as arrangement provides for a complete circumferential contact of the outer periphery 170 of the gear 110.

Preferably, the cleaning members 104 are equally spaced around the body 102. As shown in FIG. 1, six cleaning members 104 are equally spaced about the body 102. It should be appreciated, however, that a smaller number, perhaps four, or a larger number, perhaps five through ten cleaning members, could be arranged around the periphery of the opening 106 provided the size of the cleaning members were appropriately modified. The applicants have found that six cleaning members 104 are well suited for the practice of the invention.

As shown in FIG. 1, the gear 110 to be cleaned is a helical gear. Helical gears have been found by the applicants to be particularly well suited for the use of the tool 100. Helical gears, while moving through the tool 100, rotate about axis 136. The rotation enhances the cleaning of the gears 110 and assists in the exposure of the entire outer periphery 170 with the cleaning members 104. It should be appreciated, however, that spur gears and other gear forms, as well as other cylindrical and non-cylindrical objects with cylindrical and non-cylindrical peripheries, may also be well suited for cleaning within the cleaning tool of this invention. When using parts with the other gear forms or non-gear parts, care must be taken to provide a sufficiently conformable and completely surrounding cleaning member to expose the entire part periphery to the cleaning member.

The cleaning member 104 of the present invention is shown in greater detail in FIGS. 2 and 2A. To assure the cleaning of the entire flank 172 of the gears 110, the cleaning members 104 are placed such that opposed cleaning members 104 are separated by a distance B which is less than the root diameter B' of the gear 110. Such an arrangement permits the contact by the cleaning member 104 with the entire flank 172 of teeth 174 of the gear 110 including roots 176 of the teeth 174 of the gear 110.

The cleaning member 104 may have any suitable shape but preferably is elongated in the direction of axis 136 (see FIG. 1). It should be appreciated that the cleaning member 104 may in fact be a ring of sleeve with a conformable periphery which would be concentric with body 102 and permit the passage of gear 110 therethrough. The cleaning member 104 preferably is in the form of a cylindrical cleaning member body located on a cylindrical stem as shown in FIGS. 1 and 2. The cleaning member body 162 may be made of any suitable durable resilient material which is conformable with the teeth 174 of the gear 110. Applicants have found that the tool 100 is particularly effective when the cleaning member body 162 is in the form of a plurality of filaments 180 which extend from the stem 160. Such a cleaning member is readily available in the form of commercially available brushes.

The brush 104 is shown in greater detail in FIG. 3. The brush 104 includes the stem 160 from which the cleaning member body 162 centrally extends. The stem 160 is preferably in the form of a pair of twisted wires 182. The wires 182 are preferably made of a suitable durable material such as a metal, preferably steel. It should be appreciated, however, that the wires 182 may also be made of a synthetic material such as a plastic. The stem 160 may alternatively be made of a single cylindrical piece. The filaments 180 extend outwardly from the stem 160. The filaments may be secured to the stem 160 by any suitable means such as welding or gluing but preferably are trapped between the wires 182 of the stem 160.

The filaments 180 may be made of any suitable durable, pliable material which may conform to the teeth 174 of the gear 110 (see FIG. 2). The filaments may be made of a metallic wire, such as steel wire, or be made of a synthetic material such as plastic. The plastic filaments 180 may be reinforced with materials to add strength, such as carbon fibers. The filaments 180 may be coated with a material to reduce the wear of the filaments or to improve the ability of the filaments 180 to clean the teeth 174 of the gears 110. The brushes 104 may be particularly engineered to optimize the cleaning of the gear 110, or be procured from commercially available brushes. Standard commercially available test tube brushes made of natural white or white Nylon®, a trademark of Dupont UK, Ltd., have been found by the applicants to be particularly effective when cleaning plastic gears. Brushes of different material, such as steel, may be more suited to gears 110 made of harder materials such as steel.

The use of a cleaning tool with conforming cleaning members eliminates the need for the use of a solution in the cleaning process which may damage the components, leave residues thereon, contribute to air pollution, and add significant implementation and recovery costs.

The use of a tool with a cleaning member eliminates the need to have the gear 110 soak for extended periods of time in a liquid, thus reducing the time to clean the gear and permit reductions in work in process inventory.

The use of the tool 100 eliminates the need for large and expensive equipment to solution treat the gears 110 to remove the contamination therefrom.

While the invention has been described with reference to the structures and embodiments disclosed herein, it is not confined to the details set forth, and encompasses such modifications or changes as may come within the purpose of the invention.

We claim:

1. A portable tool for removing contamination from teeth of a gear which may be held by an operator, comprising:

a portable body defining an aperture therethrough, said body including a portion thereof for gripping by the operator; and a brush including a pair of twisted wires and a plurality of filaments interposed between said pair of twisted wires, said brush attached to said body and adjacent to the aperture.

2. The tool of claim 1, wherein said filaments comprises a plastic material.

3. The tool of claim 1, wherein said filaments comprise a metallic

4. A portable tool for removing contamination from teeth of a gear which may be held by an operator, comprising;

a portable body defining an aperture therethrough, said body including a portion thereof for gripping by the operator;

means for cleaning the teeth of the gear, said cleaning means attached to said body and adjacent to the aperture; and means for urging the gear through the aperture of said body.

5. The tool of claim 4, wherein said urging means comprises a member having the gear supported thereby, said member being movable through the aperture of said body.

6. A tool for removing contamination from teeth of a gear, comprising:

a body defining an aperture therethrough;

means for cleaning the teeth of the gear, said cleaning means attached to said body adjacent to the aperture; and a journal having the gear mounted slidably thereon for urging the gear through the aperture of said body, said member being movable through the aperture of said body.

7. The tool of claim 6, wherein said member further comprises a shoulder extending from an end of said journal for limiting the movement of the gear along said journal.

8. A tool for removing contamination from teeth of a gear during the conveying of the gear from a first position outside the tool to a second position, opposed to the first position, outside the tool and spaced from the first position, comprising:

a body defining an aperture therethrough; and means for cleaning the teeth of the gear, said cleaning means attached to said body and extending inwardly into the aperture, said cleaning means defining a passageway within the aperture the passageway extending from the first position to the second position, permitting the gear to be conveyed completely through the tool from the first position to the second position.

9. The tool of claim 8 wherein the gear is permitted to rotate about an axis parallel to the longitudinal axis of the aperture, so that the contamination may be more thoroughly cleaned.

10. The tool of claim 8, wherein said cleaning means comprises:

a shank; and a plurality of filaments extending from said shank.

11. The tool of claim 8, wherein said cleaning means comprises a brush.

12. A tool for removing contamination from teeth of a gear during the conveying of the gear from a first position to a second position spaced from the first position, comprising:

a body defining an aperture therethrough; and a brush attached to said body and extending inwardly into the aperture, said brush including a pair of twisted wires and a plurality of filaments interposed between said pair of twisted wires, the gear slidably fitted to said brush to permit the gear to pass completely through the aperture of said body so that the gear conveyed from the first position to the second position and passing through said body will have contamination removed therefrom.

13. The tool of claim 12, wherein said filaments comprises a plastic material.

14. The tool of claim 12, wherein said filaments comprise a metallic wire.

15. A tool for removing contamination from teeth a gear during the conveying of the gear from a first position to a second position spaced from the first position, comprising:

a body defining aperture therethrough;

means for cleaning the teeth of the gear, said cleaning means attached to said body and extending inwardly into the aperture, the gear slidably fitted to the cleaning means to permit the gear to pass completely through the aperture of said body so that the gear conveyed from the first position to the second position and passing through said body will have contamination removed therefrom; and a member for urging the gear through the aperture of said body, said member having the gear secured thereto, said member being movable through the aperture of said body.

* * * * *